US011118346B2

(12) United States Patent
Klein et al.

(10) Patent No.: US 11,118,346 B2
(45) Date of Patent: Sep. 14, 2021

(54) SYSTEMS AND METHODS FOR A FILLER ELEMENT FOR SEALING A METAL DECK

(71) Applicant: Hilti Aktiengesellschaft, Schaan (LI)

(72) Inventors: Manfred Klein, Kaufering (DE); Christian Förg, Lamerdingen (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 15/733,114

(22) PCT Filed: Dec. 3, 2018

(86) PCT No.: PCT/EP2018/083327
§ 371 (c)(1),
(2) Date: May 19, 2020

(87) PCT Pub. No.: WO2019/134778
PCT Pub. Date: Jul. 11, 2019

(65) Prior Publication Data

US 2020/0362551 A1 Nov. 19, 2020

(30) Foreign Application Priority Data

Jan. 3, 2018 (EP) ..... 18150169

(51) Int. Cl.
*E04B 1/66* (2006.01)
*E04B 1/88* (2006.01)
(Continued)

(52) U.S. Cl.
CPC ..... *E04B 1/66* (2013.01); *E04B 1/88* (2013.01); *E04B 1/946* (2013.01); *E04B 5/40* (2013.01)

(58) Field of Classification Search
CPC ... E04B 1/66; E04B 1/88; E04B 1/946; E04B 1/948; E04B 5/40
(Continued)

(56) References Cited

U.S. PATENT DOCUMENTS 716,628 A * 12/1902 Dickey ..... E04B 5/40 52/332
3,667,175 A * 6/1972 Bjorksten ..... E04B 2/8664 52/144
(Continued)

FOREIGN PATENT DOCUMENTS

DE 102005011817 A1 * 9/2006 ..... E04C 3/294
EP 1 264 943 12/2002
(Continued)

OTHER PUBLICATIONS

JP H074620 U Pubn-Date: Jan. 24, 1995 patent publication retrieved from EAST Apr. 15, 2021 with unavailabe inventor or title. (Year: 2021).*
(Continued)

*Primary Examiner* — Brian D Mattei
*Assistant Examiner* — Joseph J. Sadlon
(74) *Attorney, Agent, or Firm* — Grüneberg and Myers PLLC

(57) ABSTRACT

A system includes a metal deck having alternating valley regions and peak regions. The alternating valley regions and peak regions form one or more flutes, and each flute of the one or more flutes includes a geometry having one or more geometrical features. The system also includes a pre-formed sealant element configured to conform to the geometry of each flute. The pre-formed sealant element includes one or more integrated features that conform to the geometrical features of each flute of the metal deck. The pre-formed sealant element is configured to seal each flute against a potential environmental source.

18 Claims, 3 Drawing Sheets

(51) Int. Cl.
*E04B 5/40* (2006.01)
*E04B 1/94* (2006.01)

(58) Field of Classification Search
USPC ..... 52/716.2
See application file for complete search history.

(56) References Cited

U.S. PATENT DOCUMENTS 3,808,763 A * 5/1974 Ollinger ..... E04B 9/16 52/22
4,017,090 A * 4/1977 Cohen ..... E04C 2/322 277/644
4,109,503 A * 8/1978 Francon ..... B21D 13/02 428/183
4,197,687 A * 4/1980 Benoit ..... E04B 5/04 52/262
4,837,994 A * 6/1989 Stohs ..... E04B 5/40 174/486
5,343,611 A * 9/1994 Lager ..... B23K 37/0426 269/303
5,881,516 A * 3/1999 Luedtke ..... E04B 1/26 52/236.3
6,023,806 A * 2/2000 Dumlao ..... B63B 5/00 14/73
6,944,997 B2 * 9/2005 Verkamp ..... E04D 3/3607 428/158
7,497,056 B2 * 3/2009 Surowiecki ..... E04B 2/7457 52/261
7,861,488 B2 * 1/2011 Giles ..... E04F 15/203 52/783.11
8,048,522 B2 * 11/2011 Ander ..... C09J 133/08 428/355 AC
8,955,275 B2 * 2/2015 Stahl, Jr. ..... E04B 2/7411 52/232
9,435,465 B1 * 9/2016 Kirschner ..... F24F 13/0254
9,523,193 B2 * 12/2016 Pilz ..... E04B 1/944
10,077,553 B2 * 9/2018 Neumayr ..... E04B 2/44
10,246,874 B2 * 4/2019 Vanker ..... E04B 1/24
10,619,347 B2 * 4/2020 Pilz ..... E04C 3/32
10,669,720 B1 * 6/2020 Pavlansky ..... E04D 3/30
2005/0229503 A1 * 10/2005 Rotter ..... E04D 13/178 52/95
2011/0056763 A1 * 3/2011 Tanase ..... B60R 13/0815 181/295
2015/0007515 A1 * 1/2015 Stahl, Jr. ..... E04B 2/7411 52/232

FOREIGN PATENT DOCUMENTS

EP 3553241 A1 * 10/2019 ..... E04B 2/7411
GB 2082647 A * 3/1982 ..... E04B 9/008
JP H0642090 2/1994
JP H074620 1/1995
WO WO-9717509 A1 * 5/1997 ..... E04C 2/28
WO WO-02075081 A1 * 9/2002 ..... E04B 1/6116
WO 2005/000496 1/2005

OTHER PUBLICATIONS

International Search Report dated Feb. 2, 2019 in PCT/EP2018/083327.
Written Opinion dated Feb. 2, 2019 in PCT/EP2018/083327.

* cited by examiner

SYSTEMS AND METHODS FOR A FILLER ELEMENT FOR SEALING A METAL DECK

CROSS-REFERENCE TO RELATED APPLICATIONS

This application is a National Stage entry under § 371 of International Application No. PCT/EP2018/083327, filed on Dec. 3, 2018, and which claims the benefit of European Application No. 18150169.3, filed on Jan. 3, 2018. The contents of each of these applications are hereby incorporated by reference in their entirety.

BACKGROUND

The present disclosure relates generally to the field of construction, and more particularly to systems and methods for forming a filler element for sealing a metal deck against environmental factors.

In contemporary building constructions, different structural components (solid walls, floors, ceilings, etc.) contact one another at various intersections. For example, one such intersection within a contemporary building construction is the area between a top track and the ceilings. In certain situations, it may be helpful to seal the spaces (e.g., gap) around these intersections so that various environmental factors (e.g., noise, smoke, fire, etc.) are not transmitted through the gap. For example, sealant compounds such as mineral wool may be installed to seal the gap from such environmental factors. However, these and other typical sealant compounds may not be form fitted to the contours of the ceiling, thereby resulting in gaps remaining within these intersections. Furthermore, these and other typical sealant compounds utilized to seal the gap may be costly and time consuming to install. For example, the sealant compound may be installed after the top track is installed—resulting in a cumbersome installation where the sealant compound is pressed into the gap to seal the opening.

Accordingly, there is a need for an element for sealing the gaps between a top track and a ceiling so that various environmental factors (e.g., noise, smoke, fire, etc.) are not transmitted through the gap. In particular, there is a need for a sealing element that is both cost effective to manufacture and efficient to install.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In a first embodiment, a system is provided. The system includes a metal deck having alternating valley regions and peak regions. The alternating valley regions and peak regions form one or more flutes, and each flute of the one or more flutes includes a geometry having one or more geometrical features. The system also includes a pre-formed sealant element configured to conform to the geometry of each flute. The pre-formed sealant element includes one or more integrated features that conform to the geometrical features of each flute of the metal deck. The pre-formed sealant element is configured to seal each flute against a potential environmental source.

In a second embodiment, a method is provided. The method includes activating an adhesion component of a pre-formed sealant element, where the pre-formed sealant element includes one or more integrated features. The method also includes inserting the pre-formed sealant element into a flute of a metal deck. The flute of the metal deck is formed of alternating valley regions and peak regions, and the flute includes a geometry having one or more geometrical features. The method also includes conforming the one or more integrated features of the pre-formed sealant element to the one or more geometrical features of the flute of the metal deck. The method also includes affixing the pre-formed sealant element to the flute of the metal deck to seal the metal deck from a potential environmental source.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
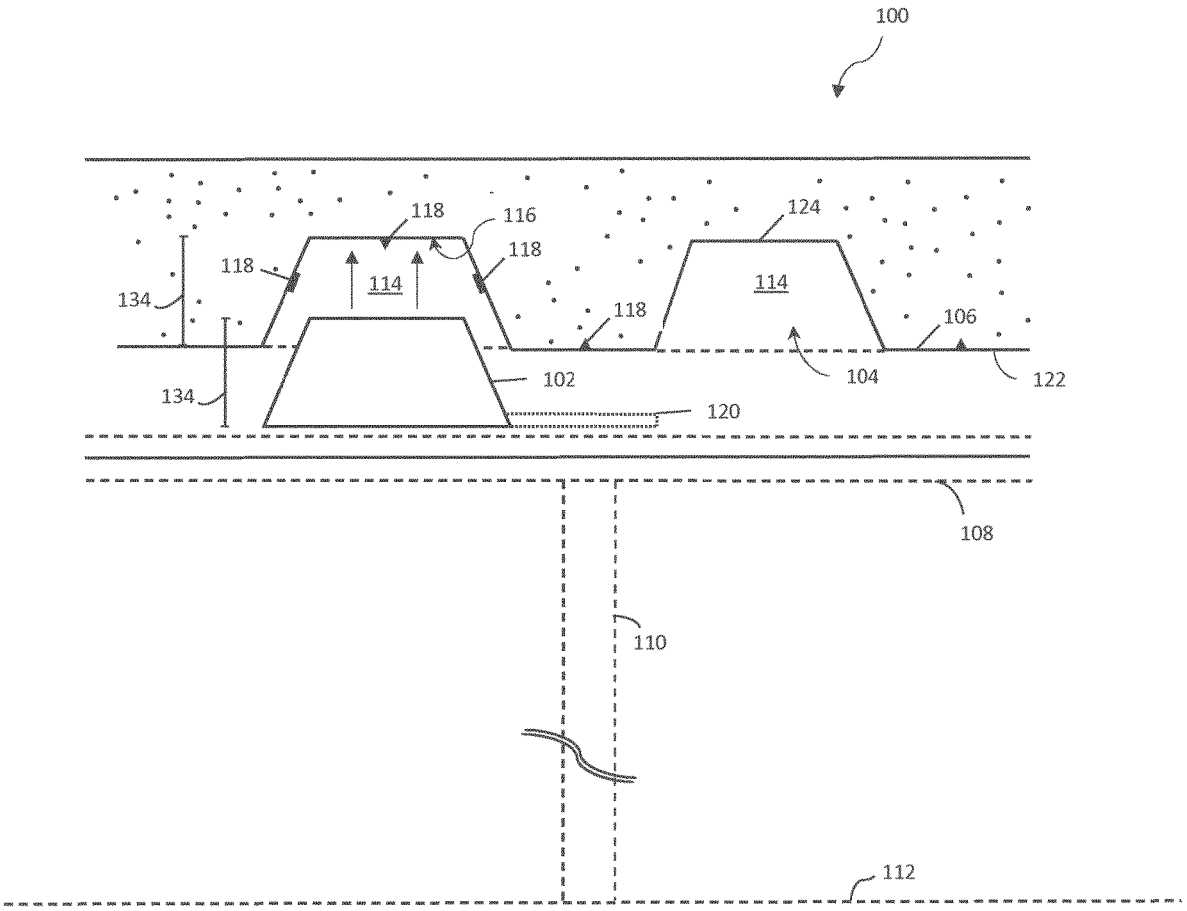
FIG. 1 is a schematic view of an embodiment of a filler element configured to seal one or more flutes of a metal deck in a construction system, in accordance with aspects of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

Present embodiments are directed to systems and methods for a sealant or filler element utilized for sealing gaps (e.g., spaces or voids) around and between various structural components (e.g., ceilings, walls, floors, etc.) in contemporary building constructions. Specifically, the filler element of the present embodiments may be described in relation to spaces or gaps between a ceiling component and a top track component. For example, in certain situations, the profile element of the present embodiments may be utilized to seal one or more flutes of a metal deck in dry wall configurations, such that various environmental factors (e.g., noise, smoke, fire, etc.) are not transmitted through the gaps. However, it should be noted that the present embodiments are not limited to the spaces between the ceiling component and an associated top track, but may be applicable and utilized to seal any spaces within a building, such as any spaces between any structural component (e.g., floors, ceilings, walls, etc.) of a building.

As noted above, typical sealant or filler compounds utilized to seal the gap may be costly and time consuming to install. For example, in typical construction situations, the sealant compound may be installed after the top track is installed—resulting in a cumbersome installation where the sealant compound is pressed into the gap to seal the opening. In the present embodiments, the sealant compound may be fixed to the top track before the top track is mounted and installed. In this manner, a customer may not need to engage in a cumbersome installation process where the sealant compound is pressed into gaps.

In certain embodiments, the sealant or filler element may be formed of any heat resistant materials or foams that are configured to protect against a threshold amount of heat. For example, in certain embodiments, the sealant element may be formed of a fire-resistant material, a fire-resistant foam, mineral wool, an ash crust creating foam, or any combination thereof. In certain embodiments, the sealant element may be formed of an intumescent material or foam that is configured to expand when triggered by a threshold amount of heat.

In certain embodiments, the filler element of the present disclosure may be manufactured as a pre-formed product having a specific geometry that is configured to conform to a flute of a metal deck. For example, in certain embodiments, the filler element may be pre-formed in a trapezoidal shape that is configured to conform to a trapezoid flute of a metal deck. In certain embodiments, the filler element may incorporate one or more features (e.g., indentations, valleys, ridges, protrusions, etc.) that are shaped to conform to one or more features of the metal deck (e.g., indentations, valley, ridges, protrusions, etc.). As a further example, in certain embodiments, the filler element may include an extension or flange that is configured to conform to additional surfaces areas of the metal deck. Further still, in certain embodiments, one or more filler elements may be arranged in a series to form a filler strip, such that the filler strip may be conformed to one or more adjacent flutes of a metal deck. Indeed, it should be noted that the filler element may be pre-formed and configured in any cross-section type, shape, or form. For example, the sealing regions of the filler element may be configured as a substantially trapezoidal shape, round shape, oval shape, polygonal shape, square shape, rectangular shape, parallelogram shape, triangular shape, or any combination thereof. Further, the filler element may include one or more features that help facilitate the installation of the filler element into the flute of the metal deck, such as, for example, an adhesion component, a sealing strip, a mineral wool, plastic film, coating to facilitate sealant properties, and so forth. These and other features are described in detail with respect to FIGS. 1-6.

With the forgoing in mind, FIG. 1 is a schematic view of an embodiment of a construction system 100. In the illustrated embodiment, the construction system 100 includes a filler element 102 (otherwise known as the sealant element 102) that is configured to seal one or more flutes 104 of a metal deck 106, in accordance with aspects of the present disclosure. The metal deck 106 may be a corrugated sheet metal having alternating valley and peak regions, and may be utilized in horizontal ceiling applications. The metal deck 106 may be cast in concrete on-site, such that the corrugated sheet metal remains on the lower side of the ceiling. In certain embodiments, a ceiling runner 108, one or more metal studs 110, and a floor runner 112 may be disposed proximate to the corrugated sheet metal 106 to facilitate the installation of dry wall configurations positioned perpendicular to the one or more flutes 104. In particular, the ceiling runner 108 may be a U-shaped component that is fixed to a bottom surface of the metal deck 106. The floor runner 112 may be fixed on the floor of the construction system 100, and the one or more metal studs 110 may be fixed between the ceiling runner 108 and the floor runner 112 in a manner that allows for vertical movement between the ceiling runner 108 and the metal studs 110. In certain embodiments, one or more gypsum boards may be fixed to the metal studs 110 in a manner to allows for defined movement between joints (e.g., between the metal deck 106 and the upper edges of the gypsum boards).

In particular, the gaps 114 (e.g., spaces or voids) within the one or more flutes 104 may be filled with a sealant component that seals the gaps 114 so that various environmental factors, (e.g., noise, smoke, fire, etc.) are not transmitted through the metal deck 106 and other components of the construction system 100. Indeed, preventing such environmental factors from being transmitted through the illustrated components of the construction system 100 may help isolate certain areas of a finished construction site (e.g., building) from environmental factors. In the disclosed embodiments, the gaps 114 may be sealed with one or more filler elements 102 that are installed into the gaps 114, as further described with respect to FIGS. 2-6. In particular, the filler element 102 may be a pre-formed heat resistant material (e.g., heat or fire resistant foam, ash crust creating foam, intumescent material or foam, mineral wool, etc.) that is configured to expand when exposed to heat. The filler element 102 may be pre-formed in a manufacturing process that utilized one or more assembly line processes and molds, thereby creating a filler element 102 that is formed to conform precisely to the geometry of the metal deck 106. In certain embodiments, the filler element 102 may be a pre-cut mineral wool material.

As noted above, the filler element 102 may be a pre-formed material that is configured to conform to the geometry of the flutes 104. For example, an inner surface 116 of each flute 104 may include one or more features 118 that protrude from and/or indent into the inner surface 116. For example, the features 118 may be ridges, valleys, depressions, protrusions, grooves, embossments, cavities, contours, etc. Furthermore, the filler element 102 may be pre-formed to conform to the one or more features 118 of each flute 104. In certain embodiments, the filler element 102 may include one or more extensions 120 (e.g., flanges) that extend the amount of surface area sealed by the filler element 102. For example, the extension 120 of the filler element 102 may be utilized to seal one or more valley regions 122 of the metal deck 106, which may be positioned adjacent to one or more peak regions 124 of the metal deck 106. It should be noted that the filler element 102 may be pre-formed to conform to any geometry of the flutes 104 and/or to any geometry of the metal deck 106. Furthermore, various components of the filler element 102 may be utilized to facilitate the installation of the filler element 102 against the metal deck 106. These and other features are described with respect to FIGS. 2-5.

Figure 2:
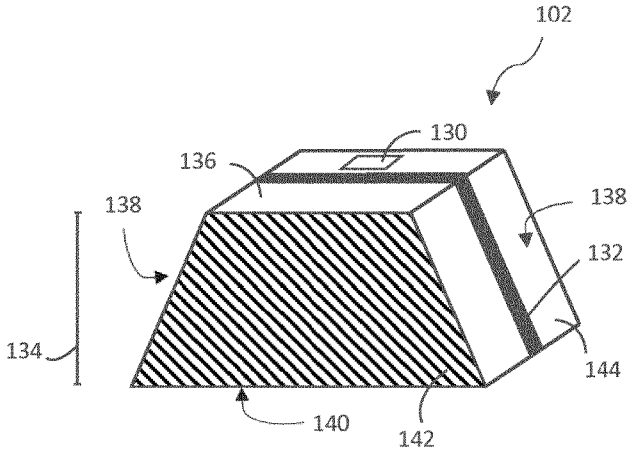
FIG. 2 is a perspective view of an embodiment of the filler element of FIG. 1, where the filler element includes an adhesion component and a sealing strip.

FIG. 2 is a perspective view of an embodiment of the filler element 102 (otherwise known as sealant element 102) of FIG. 1, where the filler element 102 includes an adhesion component 130 and a sealing strip 132. In certain embodiments, the filler element 102 may be a trapezoid shaped plug (e.g., sealant) that is configured as a fire resistant plug. As noted above, the filler element 102 may be formed of a heat resistant material (e.g., heat or fire resistant foam, ash crust creating foam, intumescent material or foam, mineral wool, etc.) that is configured to expand and further seal spaces proximate to the metal deck 106 when exposed to a heat source. In particular, the dimensions of the filler element 102 (e.g., height, width, length) are shaped to fit within the flute 104 of the metal deck 106. For example, the filler element 102 may have a height 134 that corresponds to the depth of the flute 104, such that the filler element 102 is flush with the valley region 122 of the metal deck 106 after installation.

In certain embodiments, the adhesion component 130 may be configured to affix the filler element 102 to any surface of the metal deck 106. The adhesion component 130 may be in shape (e.g., rectangle, square, strip, circle, etc.) or size, and may encompass any portion or region of the filler element 102. For example, the adhesion component 130 may be disposed on a top surface 136, one or more side surfaces 138, and/or a bottom surface 140 of the filler element 102. In certain embodiments, the top surface 136 of the filler element 102 may be configured to contact the inner surface 118 of the flute 114 of the metal deck 106. In certain embodiments, the adhesion component 130 may be covered by a disposable strip of wax paper (or similar material), and maybe removed prior to installing the filler element 102 to the metal deck 106.

In certain embodiments, the sealing strip 132 may be configured to further conform to the geometry (e.g., ridges, valleys, depressions, protrusions, grooves, embossments, cavities, contours, etc.) of the flutes 104. In particular, the sealing strip 132 may facilitate a precise seal against the metal deck 106, in order to seal uneven surfaces and/or other unique geometries along the surface of metal deck 106. In certain embodiments, the sealing strip 132 may be formed of a heat resistant material or foam to compensate for any shrinkage of the filler element 102 in the event that the filler element 102 is exposed to a heat source.

In certain embodiments, the filler element 102 may include a coating 142 and/or a plastic film 144 on exposed surfaces (e.g., side surfaces 138). The coating 142 may be applied to the filler element 102 during and/or after the manufacturing process where the filler element 102 is formed. In certain embodiments, the coating 142 may be utilized to seal the gaps 114 around the metal deck 106 from air, thereby giving the metal deck 106 an air tight sealant feature. The coating 142 may be spray applicated, printed acrylic, a silicone material, a film layer, and/or other airtight fabrics or materials. In certain embodiments, the plastic film 144 may additionally or alternatively be provided on the exposed surfaces (e.g., side surfaces 138) of the filler element 102. The plastic film 144 may be configured to improve handling properties of the filler element 102. For example, the plastic film 144 may be configured to minimize interaction between an operator (e.g., installer of the filler element 102) and fibers/textures of the heat resistant material (e.g., heat or fire resistant foam, ash crust creating foam, intumescent material or foam, mineral wool, etc.). Furthermore, the plastic film 144 may provide a smooth surface upon which to install the adhesive component 130.

Figure 3:
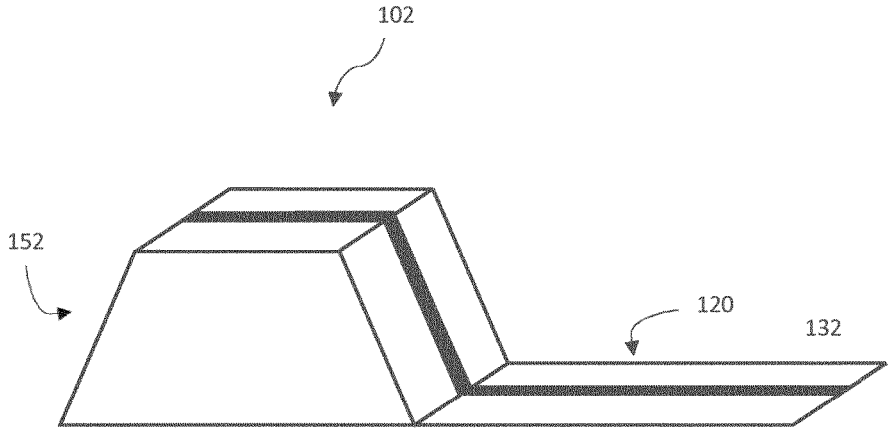
FIG. 3 is a perspective view of an embodiment of the filler element of FIG. 1, where the filler element includes a flange extension.

FIG. 3 is a perspective view of an embodiment of the filler element 102 (otherwise known as sealant element 102) of FIG. 1, where the filler element 102 includes a flange extension 120. As noted above, in certain embodiments, the filler element 102 may include a flange extension 120 that is configured to extend the amount of surface area sealed by the filler element 102. For example, the extension 120 of the filler element 102 may be utilized to seal one or more valley regions 122 of the metal deck 106, which may be positioned adjacent to one or more peak regions 124 of the metal deck 106. In the illustrated embodiment, the extension 120 of the filler element 102 is disposed on a first side 150. However, it should be noted that the extension 120 of the filler element 102 may be disposed on a second side 152 opposite to the first side 150. In this manner, the filler element 102 may be configured to seal the spaces 114 within the flute 104 and may additionally seal areas or regions proximate to the flute 104. Accordingly, in certain embodiments, the filler element 102 may be configured to seal the alternating valley and peak regions 122, 124 of the metal deck 106 in an efficient manner.

Figure 4:
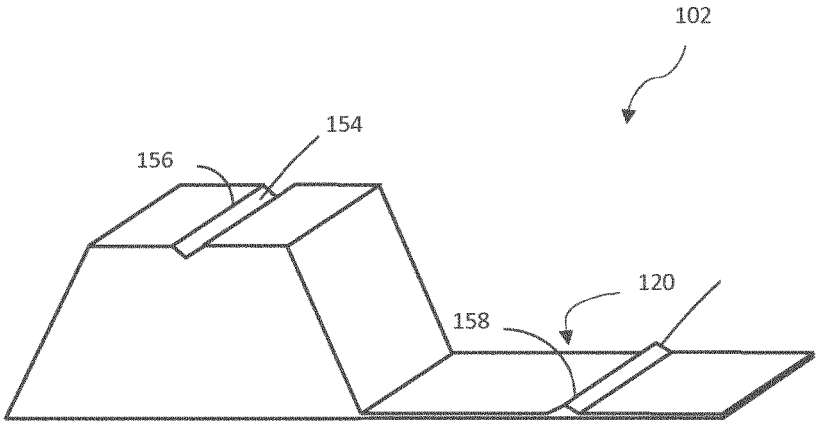
FIG. 4 is a perspective view of an embodiment of the filler element of FIG. 1, where the filler element includes one or more integrated elements that conform to a geometry of a flute of the metal deck.

FIG. 4 is a perspective view of an embodiment of the filler element 102 (otherwise known as sealant element 102) of FIG. 1, where the filler element 102 includes one or more integrated elements 154 that conform to the geometry of the flute 104 of the metal deck 106. Specifically, each flute 104 may include one or more features 118 that protrude from and/or indent into the metal deck 106. For example, the features 118 may be ridges, valleys, depressions, protrusions, grooves, embossments, cavities, contours, etc. Accordingly, it may be beneficial to pre-form the filler element 102 in a manner that conforms to the features 118 of the metal deck 106. For example, the pre-formed filler element 102 may be configured to include one or more integrated elements 154, such as ridges, valleys, depressions, protrusions, grooves, embossments, cavities, contours, etc., that correspond directly to the features of the metal deck 106. For example, in the illustrated embodiment, the filler element 102 includes an indentation 156 that conforms to a protrusion feature 118 along the length of the flute 104. Further, in the illustrated embodiment, the filler element 102 includes a raised portion 158 that conforms to the raised portion feature 118 along the length of the flute 104.

In this manner, the filler element 102 may be configured to conform precisely to the geometries of the metal deck 106. Furthermore, such a pre-formed design may facilitate the installation process, since an installer may be able to view the shape of the filler element 102 and quickly understand the direction of the installation process, as further described with respect to FIG. 6.

Figure 5:
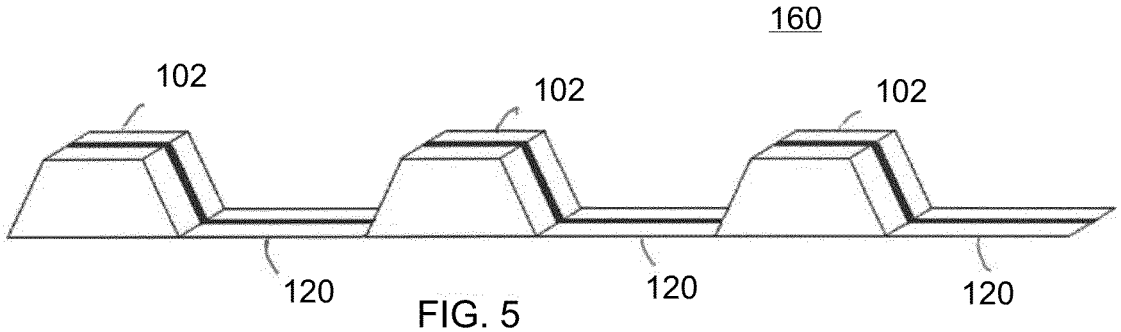
FIG. 5 is a perspective view of an embodiment of a strip of filler elements, where the strip includes one or more filler elements of FIG. 1.

FIG. 5 is a perspective view of an embodiment of a strip 160 that includes two or more filler elements 102 (otherwise known as sealant elements 102) of FIG. 1, in accordance with an aspect of the present embodiments. In certain embodiments, the filler element 102 may be formed in series, such that adjacent filler elements 102 are coupled with the extension 120. In this manner, a series of continuous filler elements 102 may be manufactured to match the continuous and alternating peaks and valleys 122, 124 of the metal deck 106.

Figure 6:
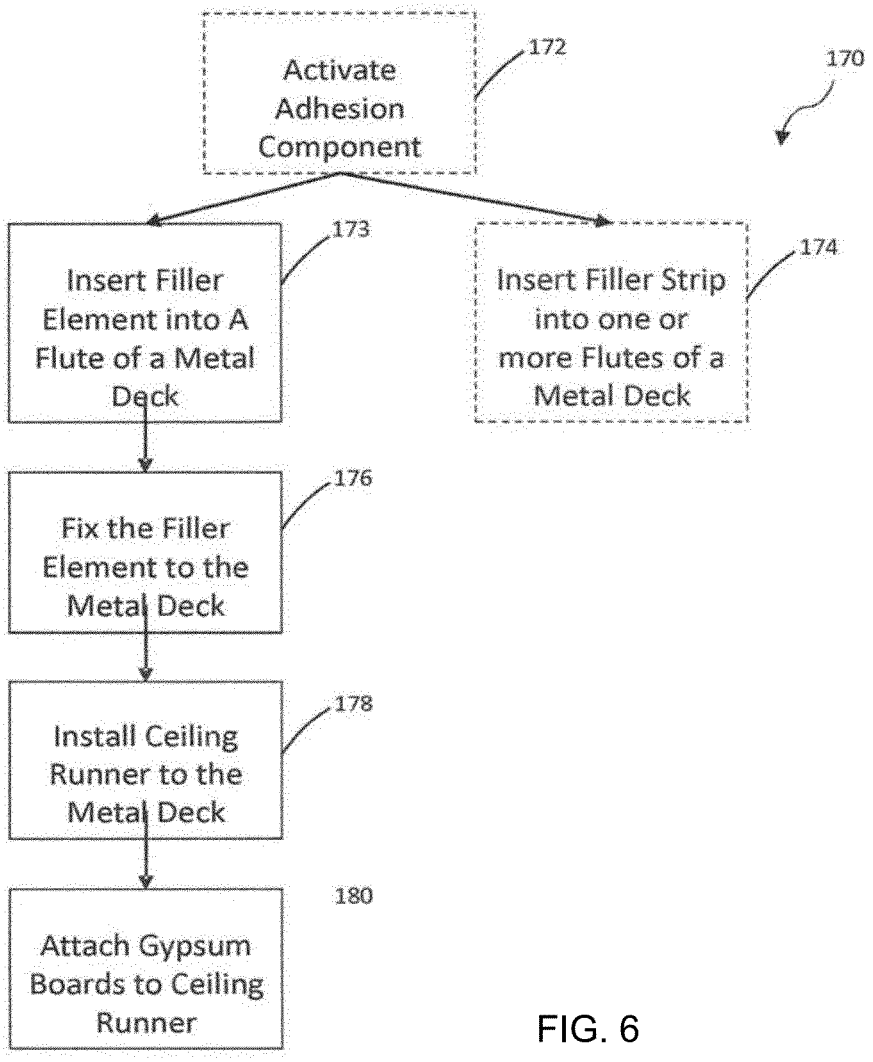
FIG. 6 is a method of an embodiment of installing the filler element of FIG. 1 within one or more flutes of a metal deck in a construction system.

FIG. 6 is a method 170 of an embodiment of installing the filler element 102 (otherwise known as sealant element 102) of FIG. 1 within one or more flutes 104 of the metal deck 106 in a construction system 100, in accordance with aspects of the present disclosure.

In certain embodiments, the method 170 includes activating the adhesion component 130 (step 172) by removing a film protecting the adhesion component 130. The method 170 further includes inserting the filler element 102 into a corresponding flute 104 of the metal deck 106 (step 173). In certain embodiments, the method 170 includes inserting the strip 160 into one or more corresponding flutes 104 of the metal deck 106 (step 174). Further, in certain embodiments, the method 170 includes fixing the filler element 102 to the metal deck 106 (step 176). After securely installing the filler element 102 to the one or more corresponding flutes 104 of the metal deck 106, additional components of the construction system 100 may be installed. For example, in certain embodiments, the method 170 includes installing the ceiling runner 108 to the metal deck 106 (step 178) and attaching the gypsum boards to the ceiling runner 108 (step 180).

Technical advantages of the present disclosure include a fast and simple installation process for seal the spaces (e.g., gap) around the spaces between the ceiling component and a top track component. Specifically, the present disclosure relates to a filler element 102 that is configured as a pre-formed sealant product for sealing the flutes 104 of a metal deck 106. In the present embodiments, the filler element 102 (otherwise known as the sealant element 102) may be fixed to the top track before the top track is mounted and installed. In this manner, a customer may not need to engage in a cumbersome installation process where the sealant compound is pressed into gaps after the top track is mounted and installed. In certain embodiments, the filler element 102 may be formed of heat resistant material (e.g., heat or fire resistant foam, ash crust creating foam, intumescent material or foam, mineral wool, etc.) that is configured to expand when triggered by a threshold amount of heat. In particular, advantages of this technique include reducing the need for special equipment or tools for cutting mineral wool or shaping heat resistant material for such spaces.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A sealing system for a metal deck, the metal deck comprising at least one valley region and at least one peak region that corresponds to a flute, the sealing system comprising:

at least one pre-formed sealing element configured to conform to a geometry of the flute; and at least one extension coupled to a side of the at least one pre-formed sealing element and configured to seal and conform to a geometry of the at least one valley region, the geometry of the flute being different from the geometry of the at least one valley region, wherein the at least one pre-formed sealing element comprises one or more first integrated features that conform to one or more corresponding first geometrical features on an inner surface of the at least one peak region of the flute of the metal deck, wherein the at least one extension comprises one or more second integrated features that conform to one or more corresponding second geometrical features on an inner surface of the at least one valley region, and wherein the at least one pre-formed sealing element is configured to seal the flute against a potential environmental source.

2. The sealing system of claim 1, wherein the at least one pre-formed sealing element further comprises: an adhesion area configured to attach the at least one pre-formed sealing element to the metal deck.

3. The sealing system of claim 1, wherein the at least one pre-formed sealing element further comprises: a sealing strip, a coating feature, a film layer, or a combination thereof configured to seal the at least one pre-formed sealing element against the metal deck.

4. The sealing system of claim 1, wherein the at least one pre-formed sealing element has a trapezoidal shape that is configured to conform to a trapezoid shape of the flute of the metal deck.

5. The sealing system of claim 1, wherein the one or more corresponding geometrical features comprise: a ridge, a valley, a depression, a protrusion, a groove, an embossment, a cavity, a contour, or a combination thereof.

6. The sealing system of claim 5, wherein the one or more first integrated features are configured to conform to respective ones of the ridge, the valley, the depression, the protrusion, the groove, the embossment, the cavity, the contour, or the combination thereof.

7. The sealing system of claim 1, further comprising:

a plurality of pre-formed sealing elements including the at least one pre-formed sealing element, the plurality of pre-formed sealing elements coupled together in series on a strip, wherein the strip is configured to conform to geometries of a plurality of corresponding flutes of the metal deck.

8. The sealing system of claim 1, wherein the environmental source comprises: a heat source, an acoustic source, a smoke source, a water source, an air source, or a combination thereof.

9. The sealing system of claim 1, wherein the at least one pre-formed sealing element has a height that corresponds to a depth of the flute, so that the at least one pre-formed sealing element fully fills and completely seals the flute.

10. The sealing system of claim 1, wherein:

the one or more first integrated features have a first shape, the one or more second integrated features have a second shape, and the first shape is different from the second shape.

11. A method, comprising:

activating an adhesion component of a pre-formed sealing element, wherein the pre-formed sealing element comprises one or more first integrated features and is coupled to an extension that comprises one or more second integrated features; and inserting the pre-formed sealing element into a flute of a metal deck and applying the extension to a valley region of the metal deck, wherein the flute of the metal deck corresponds to a peak region adjacent to the valley region, the peak region comprising an inner surface having one or more first geometrical features that are complementary to the one or more first integrated features of the pre-formed sealing element, and the valley region comprising an inner surface having one or more second geometrical features that are complementary to the one or more second integrated features of the extension, wherein inserting the pre-formed sealing element and applying the extension comprise:

positioning the one or more first integrated features of the pre-formed sealing element in correspondence with the one or more first geometrical features of the flute of the metal deck and the one or more second integrated features of the extension in correspondence with the one or more second geometrical features of the valley region; and affixing the pre-formed sealing element to the inner surface of the peak region and the extension to the inner surface of the valley region of the metal deck to seal the metal deck from a potential environmental source.

12. The method of claim 11, further comprising:

positioning a ceiling runner underneath the metal deck, and attaching one or more gypsum boards to the ceiling runner, wherein the ceiling runner is pre-attached to a pre-formed sealing strip.

13. The method of claim 11, further comprising:

inserting a strip of one or more pre-formed sealing elements into one or more flutes of the metal deck.

14. The method of claim 11, wherein the one or more first geometrical features of the peak region comprises: a ridge, a valley, a depression, a protrusion, a groove, an embossment, a cavity, a contour, or a combination thereof.

15. The method of claim 14, wherein the one or more first integrated features of the pre-formed sealing element conform to the ridge, the valley, the depression, the protrusion, the groove, the embossment, the cavity, the contour, or the combination thereof, of the one or more first geometrical features.

16. The method of claim 11, wherein the pre-formed sealing element has a trapezoidal shape that is configured to conform to a trapezoid shape of the flute of the metal deck.

17. An apparatus, comprising:

a seal having a first shape that conforms to a second shape of a flute of a metal deck; and an extension coupled to the seal and having a shape corresponding to a valley of the metal deck adjacent to the flute, wherein:

the seal comprises a surface comprising a first feature that is complementary to a second feature disposed along an inner surface of a peak region corresponding to the flute, the seal having a size that completely fills the flute in an installed state within the flute, the first feature coupled to the second feature in the installed state, and the extension comprises a surface comprising a third feature that is complementary to a fourth features disposed along an inner surface of a valley region adjacent to the peak region.

18. The apparatus of claim 17, wherein:

the first feature includes a protrusion and the second feature includes a depression, or the first feature includes a depression and the second feature includes a protrusion.

* * * * *